US010828901B1

(12) United States Patent
Gutberlet et al.

(10) Patent No.: US 10,828,901 B1
(45) Date of Patent: Nov. 10, 2020

(54) PRINTHEAD CAP FOR ATTENUATING THE DRYING OF INK FROM A PRINTHEAD DURING PERIODS OF PRINTER INACTIVITY

(71) Applicant: Xerox Corporation, Norwalk, CT (US)

(72) Inventors: Douglas A. Gutberlet, Ontario, NY (US); Richard A. Kalb, Rochester, NY (US); Patrick J. Howe, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/416,817

(22) Filed: May 20, 2019

(51) Int. Cl.
*B41J 2/165* (2006.01)
*B41J 2/17* (2006.01)

(52) U.S. Cl.
CPC ..... *B41J 2/16511* (2013.01); *B41J 2/16552* (2013.01); *B41J 2/1707* (2013.01); *B41J 2002/16597* (2013.01)

(58) Field of Classification Search
CPC .. B41J 2/16511; B41J 2/1707; B41J 2/16552; B41J 2002/16597
See application file for complete search history.

(56) References Cited

U.S. PATENT DOCUMENTS

| | | | | |
|---|---|---|---|---|
| 7,275,802 | B2 * | 10/2007 | Berardelli | B41J 2/16547 347/22 |
| 2003/0025755 | A1 | 2/2003 | Baxter et al. | |
| 2004/0075702 | A1 * | 4/2004 | Waller | B41J 2/16547 346/36 |
| 2004/0104961 | A1 | 6/2004 | Hashi et al. | |
| 2004/0160472 | A1 | 8/2004 | Khalid et al. | |
| 2004/0189739 | A1 | 9/2004 | Okamoto | |
| 2008/0088666 | A1 | 4/2008 | Shindo et al. | |
| 2008/0218554 | A1 | 9/2008 | Inoue | |
| 2009/0141073 | A1 | 6/2009 | Umeda | |
| 2011/0090280 | A1 | 4/2011 | Hibbard et al. | |
| 2011/0279535 | A1 | 11/2011 | Love et al. | |
| 2012/0320126 | A1 | 12/2012 | Martin et al. | |
| 2013/0038662 | A1 | 2/2013 | Karppinen et al. | |
| 2017/0297339 | A1 | 10/2017 | Midorikawa | |

* cited by examiner

*Primary Examiner* — Sharon Polk
(74) *Attorney, Agent, or Firm* — Maginot Moore & Beck LLP

(57) ABSTRACT

A capping station is configured for storing a printhead during printer inactivity to restore and preserve the operational status of the nozzles in the printhead. Each capping station has a receptacle having at least one wall and a floor configured to enclose a volume partially, and a sealing member mounted to an upper surface of the at least one wall of the receptacle so the sealing member extends away from the upper surface of the at least one wall. The sealing member has a surface that slopes toward the volume within the receptacle to direct fluid on the sloping surface of the sealing member into the volume within the receptacle.

18 Claims, 10 Drawing Sheets

PRINTHEAD CAP FOR ATTENUATING THE DRYING OF INK FROM A PRINTHEAD DURING PERIODS OF PRINTER INACTIVITY

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

A prior art ink delivery system 20 used in inkjet imaging devices is shown in FIG. 5. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to block the conduit 634 selectively. A valve 612 is also provided in the conduit 614 to connect an air pressure pump 616 to the ink reservoir 604 and this valve remains open to atmospheric pressure except during purging operations.

When a new printhead is installed or its manifold needs to be flushed to remove air in the conduit 618, a manifold purge is performed. In a manifold purge, the controller 80 operates the valve 642 to enable fluid to flow from the manifold outlet to the waste ink tank 638, activates the air pressure pump 616, and operates the valve 612 to close the ink reservoir to atmospheric pressure so pump 616 can pressurize the ink in the ink reservoir 604. The pressurized ink flows through conduit 618 to the manifold inlet of printhead 608. Because valve 642 is also opened, the pneumatic impedance to fluid flow from the manifold to the inkjets is greater than the pneumatic impedance through the manifold. Thus, ink flows from the manifold outlet to the waste tank. The pressure pump 616 is operated at a predetermined pressure for a predetermined period of time to push a volume of ink through the conduit 618 and the manifold of the printhead 608 that is sufficient to fill the conduit 618, the manifold in the printhead 608, and the conduit 634 without completely exhausting the supply of ink in the reservoir. The controller then operates the valve 642 to close the conduit 634 and operates the valve 612 to vent the ink reservoir to atmospheric pressure. Thus, a manifold purge fills the conduit 618 from the ink reservoir to the printhead, the manifold, and the conduit 634 so the manifold and the ink delivery system are primed since no air is present in the conduits or the printhead. The ink reservoir is then resupplied to bring the height of the ink to a level where the distance between the level in the reservoir and the printhead inkjets is D as previously noted.

To prime the inkjets in the printhead 608 following a manifold prime, the controller 80 closes the valve 612 and activates the air pressure pump 616 to pressurize the head space of the reservoir 604 to send ink to the printhead. Because the valve 642 is closed, the pneumatic impedance of the primed system through the manifold is greater than the pneumatic impedance through the inkjets so ink is urged into the inkjets. Again, the purge pressure is exerted at a predetermined pressure for a predetermined period of time to urge a volume of ink into the printhead that is adequate to fill the inkjets. Any ink previously in the inkjets is emitted from the nozzles in the faceplate 624 of the printhead 608. This ink purging primes the inkjets and can also help restore clogged and inoperative inkjets to their operational status. After the exertion of the pressure, the controller 80 operates the valve 612 to open and release pressure from the ink reservoir. A pressure sensor 620 is also operatively connected to the pressure supply conduit 622 and this sensor generates a signal indicative of the pressure in the reservoir. This signal is provided to the controller 80 for regulating the operation of the air pressure pump. If the pressure in the reservoir during purging exceeds a predetermined threshold, then the controller 80 operates the valve 612 to release pressure. If the pressure in the reservoir drops below a predetermined threshold during purging, then the controller 80 operates the pressure source 616 to raise the pressure. The two predetermined thresholds are different so the controller can keep the pressure in the reservoir in a predetermined range during purging rather than at one particular pressure.

Some inkjet imaging devices use inks that change from a low viscosity state to a high viscosity state relatively quickly. In a prior art printer, a capping station, such as the station 60 shown in FIG. 6A and FIG. 6B, is used to cover a printhead when the printer is not in use. The cap is formed as a receptacle 704 to collect ink produced by the printhead 708 during a purge of the printhead. An actuator (not shown) is operated to move the printhead 708 into contact with an opening in the receptacle 704 as shown in FIG. 6B so the printhead can be purged to restore inkjets in the printhead by applying pressure to the ink manifold and passageways in the printhead. This pressure urges ink out of the nozzles in the faceplate of the printhead. This ink purging helps restore clogged and inoperative inkjets to their operational status, although the amount of lost ink can be significant. The ink purged from the printhead is directed to an exit chute 712 so the ink can reach a waste receptacle. The cap receptacle 704 also helps keep the ink in the nozzles from drying out because the printhead face is held within the enclosed space of the cap receptacle rather than being exposed to circulating ambient air. After multiple capping operations, however, ink on the faceplate can adhere to the seals around the perimeters of the capping station and adversely impact the integrity of the seal around the printhead faceplate. Being able to improve the ability of the capping station to preserve the operational status of the inkjets during a period of printhead inactivity would be beneficial.

SUMMARY

A capping station is configured to reduce the drying of ink on the seals of the capping station and includes structure to preserve the operational status of the inkjets more effectively. The capping station includes a receptacle having at least one wall and a floor configured to enclose a volume partially and a sealing member mounted to an upper surface of the at least one wall of the receptacle so the sealing member extends away from the upper surface of the at least one wall, the sealing member having a surface that slopes at an angle from a vertical line extending from the upper surface of the wall forming the receptacle in a direction away from the volume partially enclosed by the receptacle to direct fluid on the sloping surface of the sealing member into the volume within the receptacle.

An inkjet printer includes the capping station configured to reduce the drying of ink on the seals of the capping station and includes structure to preserve the operational status of the inkjets more effectively. The inkjet printer includes a plurality of printheads; and a capping station for each printhead in the plurality of printheads. Each capping station includes a receptacle having at least one wall and a floor configured to enclose a volume partially and a sealing member mounted to an upper surface of the at least one wall of the receptacle so the sealing member extends away from the upper surface of the at least one wall, the sealing member having a surface that slopes at an angle from a vertical line extending from the upper surface of the wall forming the receptacle in a direction away from the volume partially enclosed by the receptacle to direct fluid on the sloping surface of the sealing member into the volume within the receptacle.

BRIEF DESCRIPTION OF THE DRAWINGS

The foregoing aspects and other features of a capping station and printer having a capping station that reduces the drying of ink on the seals of the capping station and includes structure to preserve the operational status of the inkjets more effectively are explained in the following description, taken in connection with the accompanying drawings.

DETAILED DESCRIPTION

Figure 1A:
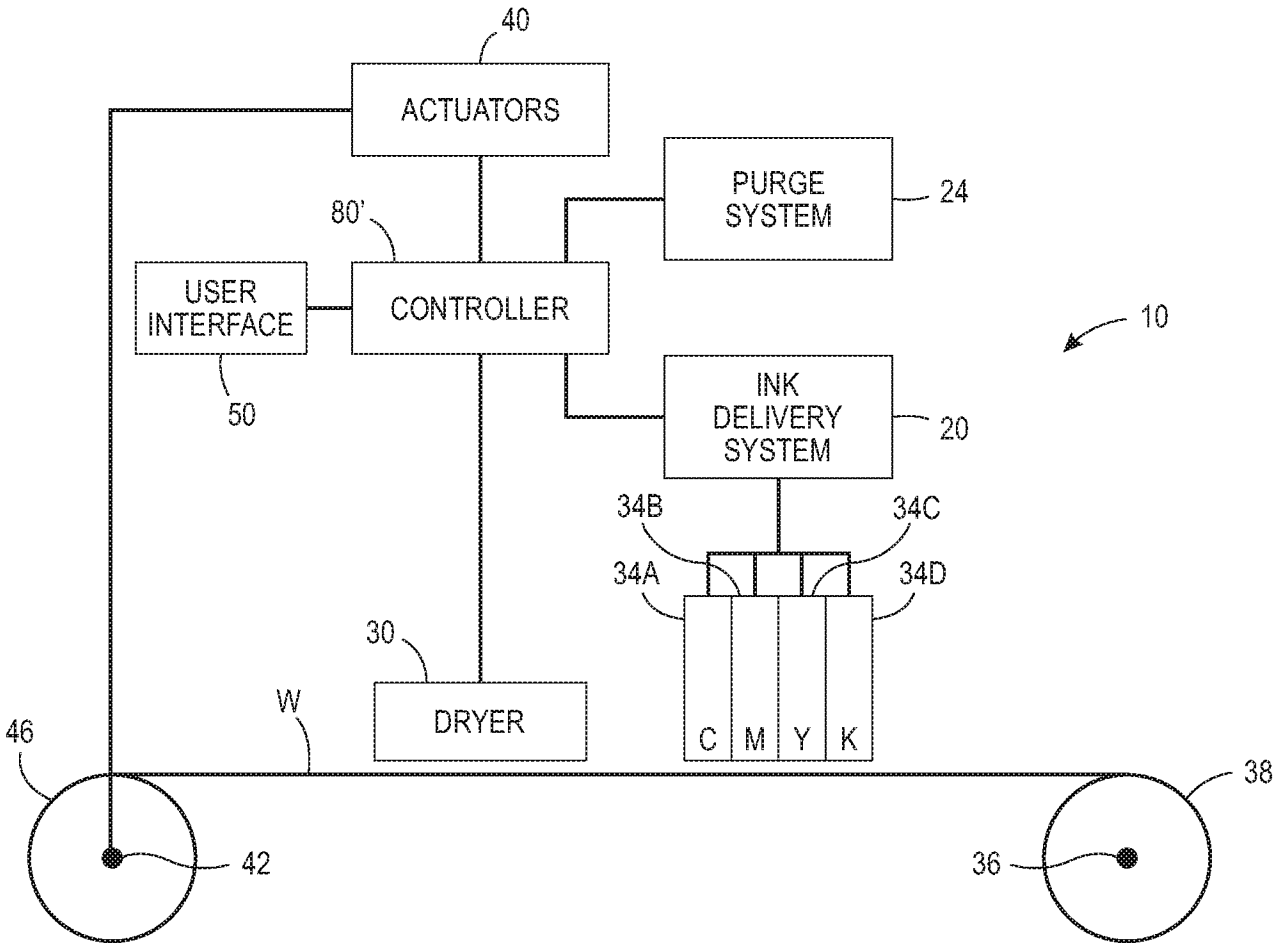
FIG. 1A is a schematic drawing of an inkjet printer that prints ink images directly to a web of media and that caps the printheads to attenuate evaporation of inks from the printheads of the printer and FIG. 1B is a side view showing the positions of the printhead array and capping stations during printing operations.

For a general understanding of the environment for the printer and capping station disclosed herein as well as the details for the printer and capping station, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. Also, the description presented below is directed to a system for preserving the operational status of inkjets in an inkjet printer during periods of printer inactivity. The reader should also appreciate that the principles set forth in this description are applicable to similar imaging devices that generate images with pixels of marking material.

FIG. 1A illustrates a high-speed aqueous ink image producing machine or printer 10 in which a controller 80' has been configured to perform the process 400 described below to operate the capping system 60' (FIG. 1B) so the ink at the nozzles of the printheads 34A, 34B, 34C, and 34D maintain a low viscosity state during periods of printhead inactivity. As illustrated, the printer 10 is a printer that directly forms an ink image on a surface of a web W of media pulled through the printer 10 by the controller 80' operating one of the actuators 40 that is operatively connected to the shaft 42 to rotate the shaft and the take up roll 46 mounted about the shaft. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction. Printer 10 can also be a printer that has a media transport system that replaces the moving web W to carry cut media sheets past the printheads for the printing of images on the sheets.

Figure 5:
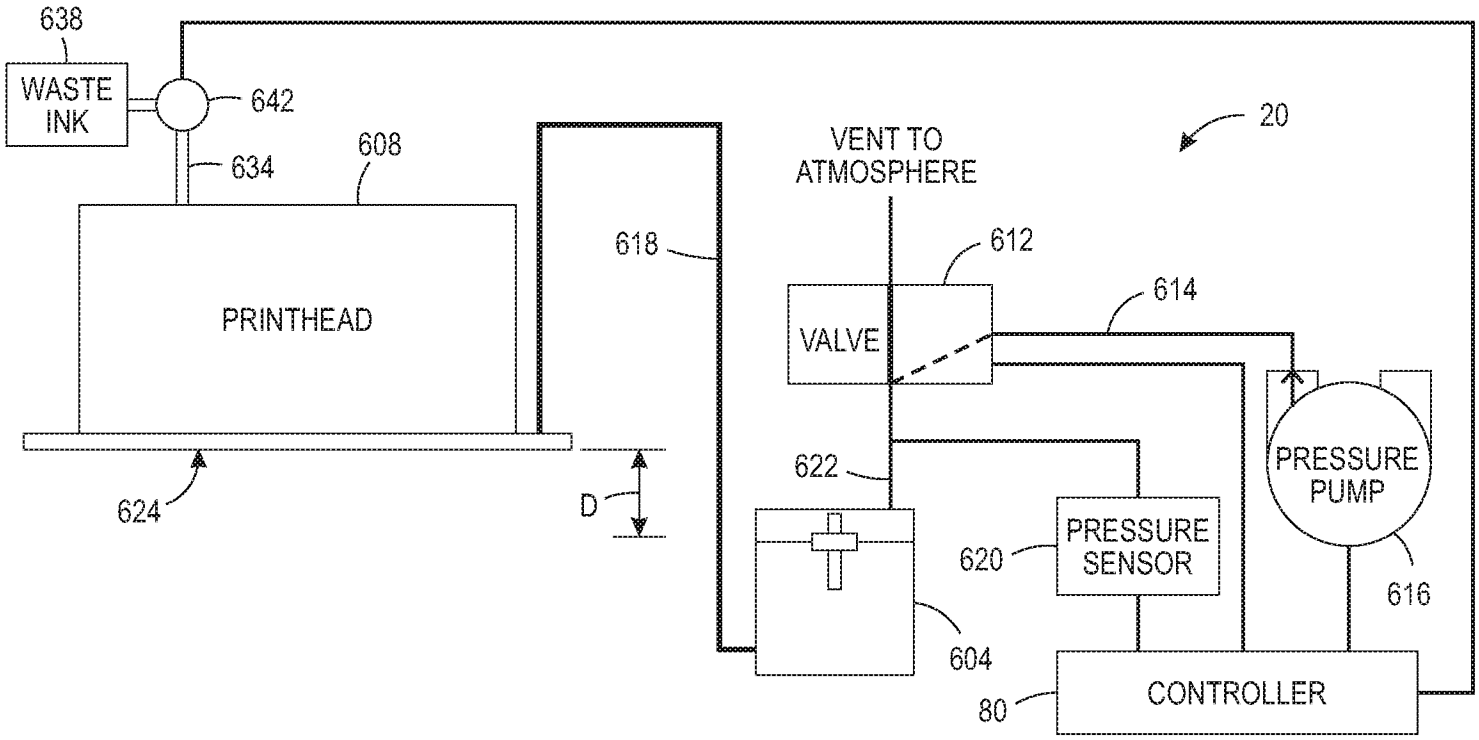
FIG. 5 PRIOR ART
FIG. 5 is a schematic diagram of a prior art ink delivery system that is used in prior art printers for purging only.
Figure 6A:
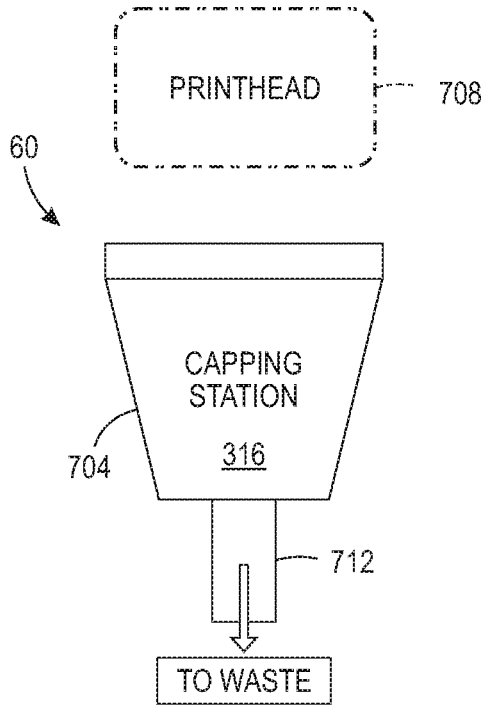
FIG. 6A PRIOR ART
FIG. 6A and FIG. 6B are schematic diagrams of a prior art capping station.
Figure 6B:
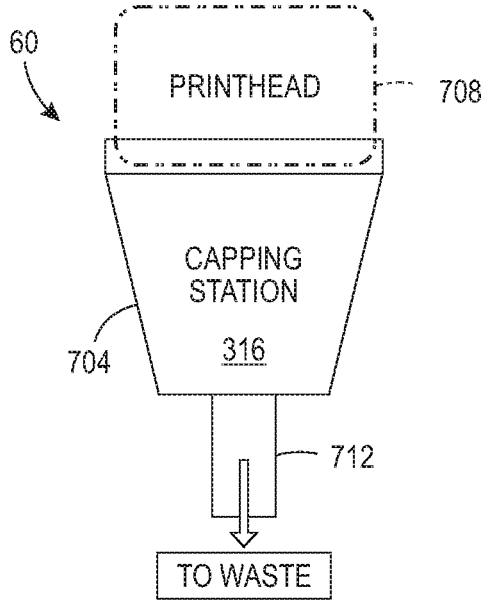
FIG. 6B PRIOR ART

The aqueous ink delivery subsystem 20, such as the one shown in FIG. 5, has at least one ink reservoir containing one color of aqueous ink. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules, as described above, to perform manifold and inkjet purges. Additionally, although not shown in FIG. 1A, each printhead in a printhead module is connected to a corresponding waste ink tank with a valve as described previously with reference to FIG. 5 to enable the collection of purged ink during the manifold and inkjet purge operations previously described. The printhead modules 34A-34D can include associated electronics for operation of the one or more printheads by the controller 80' although those connections are not shown to simplify the figure. Although the printer 10 includes four printhead modules 34A-34D, each of which has two arrays of printheads, alternative configurations include a different number of printhead modules or arrays within a module. The controller 80' also operates the capping system 60' and one or more actuators 40 that are operatively connected to components in the capping system 60' to preserve the low viscosity of the ink in the nozzles of the printheads in the printhead modules as described more fully below.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by the controller 80' operating one or more actuators 40 to rotate the shaft 42 on which the take up roll 46 is placed to pull the web from the media roll 38 as it rotates with the shaft 36. When the web is completely printed, the take-up roll can be removed from the shaft 42. Alternatively, the printed web can be directed to other processing stations (not shown) that perform tasks such as cutting, collating, binding, and stapling the media.

Operation and control of the various subsystems, components and functions of the machine or printer 10 are performed with the aid of a controller or electronic subsystem (ESS) 80'. The ESS or controller 80' is operably connected to the components of the ink delivery system 20, the purge system 24, the printhead modules 34A-34D (and thus the printheads), the actuators 40, the heater 30, and the capping station 60'. The ESS or controller 80', for example, is a self-contained, dedicated mini-computer having a central processor unit (CPU) with electronic data storage, and a display or user interface (UI) 50. The ESS or controller 80', for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80' is the main multi-tasking processor for operating and controlling all of the other machine subsystems and functions, including the printing process.

The controller 80' can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80' from either a scanning system or an online or work station connection for processing and generation of the printhead control signals output to the printhead modules 34A-34D. Additionally, the controller 80' determines and accepts related subsystem and component controls, for example, from operator inputs via the user interface 50 and executes such controls accordingly. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 1B:
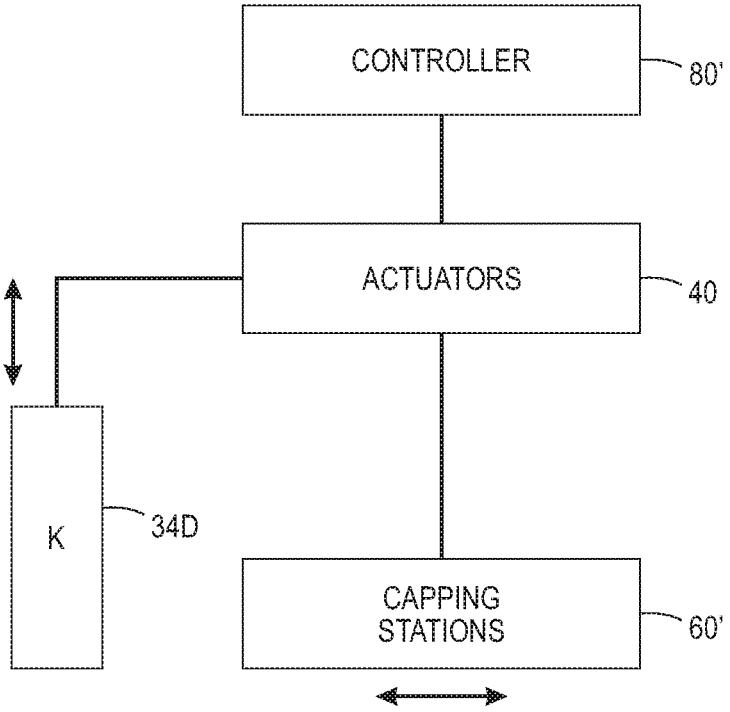

As shown in FIG. 1B, a plurality of capping stations 60' are positioned behind the printhead modules 34A, 34B, 34C, and 34D during printing operations. When one of more printheads need long term storage, the corresponding printhead is raised by the controller 80' operating one of the actuators 40 and the corresponding capping station 60' is moved opposite and underneath the raised printhead by the controller 80' operating another one of the actuators 40. The controller 80' then operates the actuators, printhead, and capping station components as described in more detail below to preserve the operational status of the printhead during a period of printhead inactivity. When the printhead is returned to operational status, the controller 80' operates the actuators 40 to lift the printhead from its capping station, return the capping station to a position behind the printhead, and lower the printhead to its printing position.

Figure 2A:
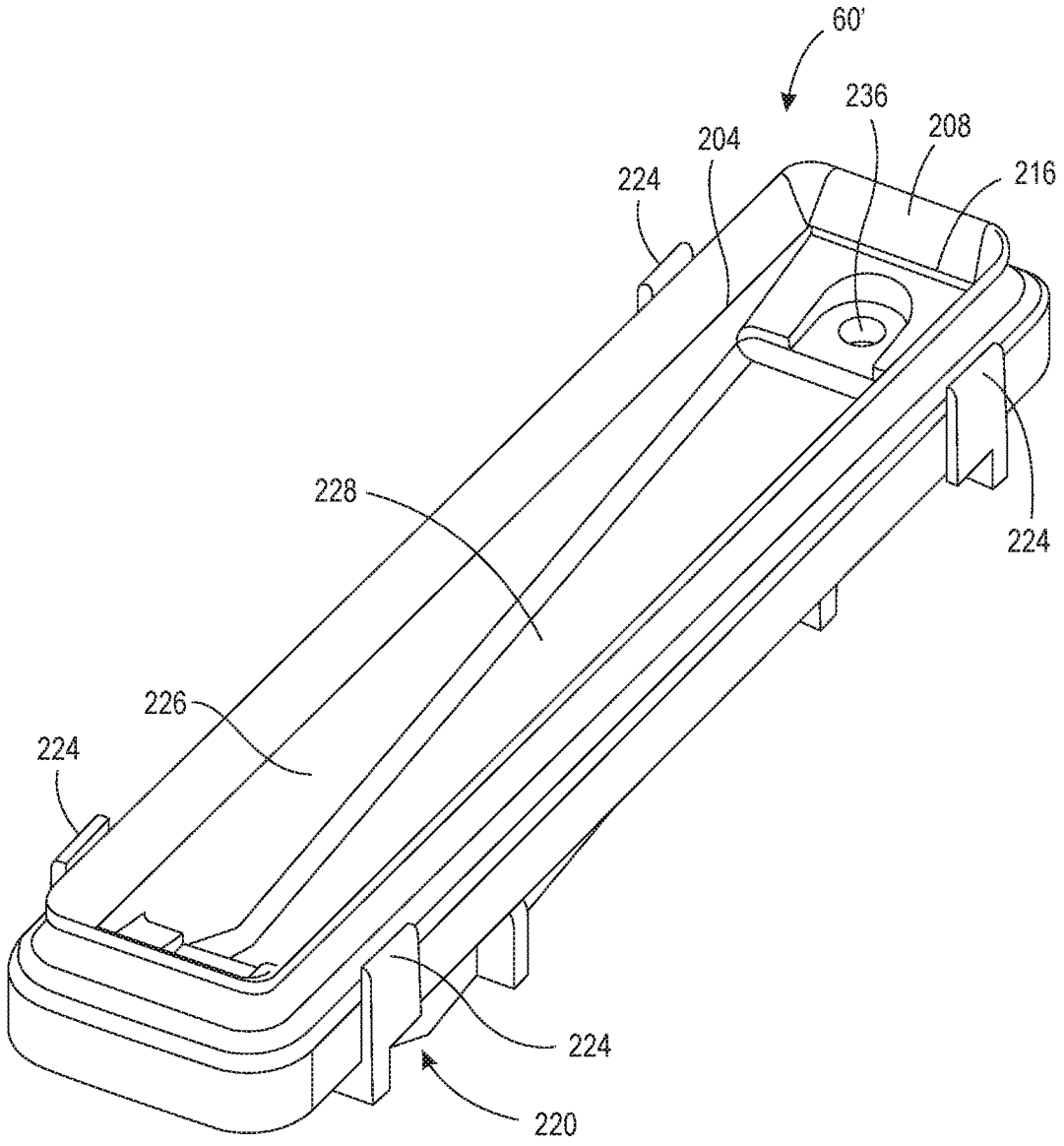
FIG. 2A is an isometric view of a printhead capping system used in the printer of FIG. 1A and FIG. 1B that helps preserve the operational status of the inkjets during a period of inactivity.

Using like numbers for like components, a capping station that can attenuate the evaporation of quickly drying inks from printheads is shown in FIG. 2A. The capping station 60' includes a receptacle 204, a sealing member 208, a vacuum connection 216, a fluid outlet 220, and locating tabs 224. The receptacle 204 is a housing having at least one wall 226 and a floor 228 that partially surrounds a volume of air. The sealing member 208 is mounted along the perimeter of the receptacle at an upper surface of the wall of the receptacle 204. This seal is made of an elastomeric material that hermetically seals the volume within the receptacle 204 when the controller 80' operates one of the actuators 40 to move the receptacle vertically toward the printhead 268 (FIG. 2B) so the sealing member contacts and surrounds the portion of the perimeter of the nozzle faceplate 264 of the printhead 268 (FIG. 2B) that is outside the nozzle array area of the faceplate. One of the actuators 40 is operatively connected to the receptacle 204 and the controller 80' to enable the controller to operate the actuator and move the capping station 60' into and out of engagement with a printhead. Vacuum connection 216 provides an inlet 232 (FIG. 2C) and an opening 236 (FIG. 2A) into the receptacle 204. A vacuum source can be connected to the inlet 232 to produce a vacuum within the receptacle 204 if one is desired to pull ink from a capped printhead in the performance of a purge.

Figure 2B:
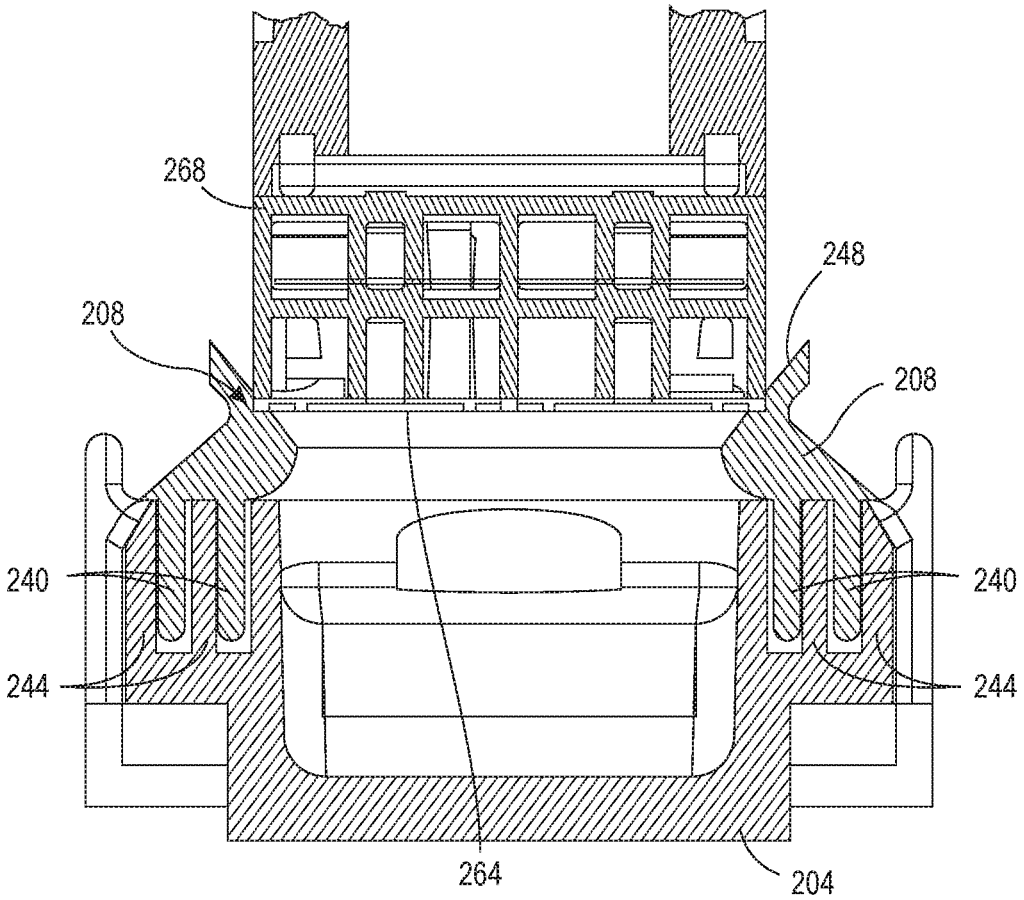
FIG. 2B is an end view of the printhead capping system of FIG. 2A.
Figure 2C:
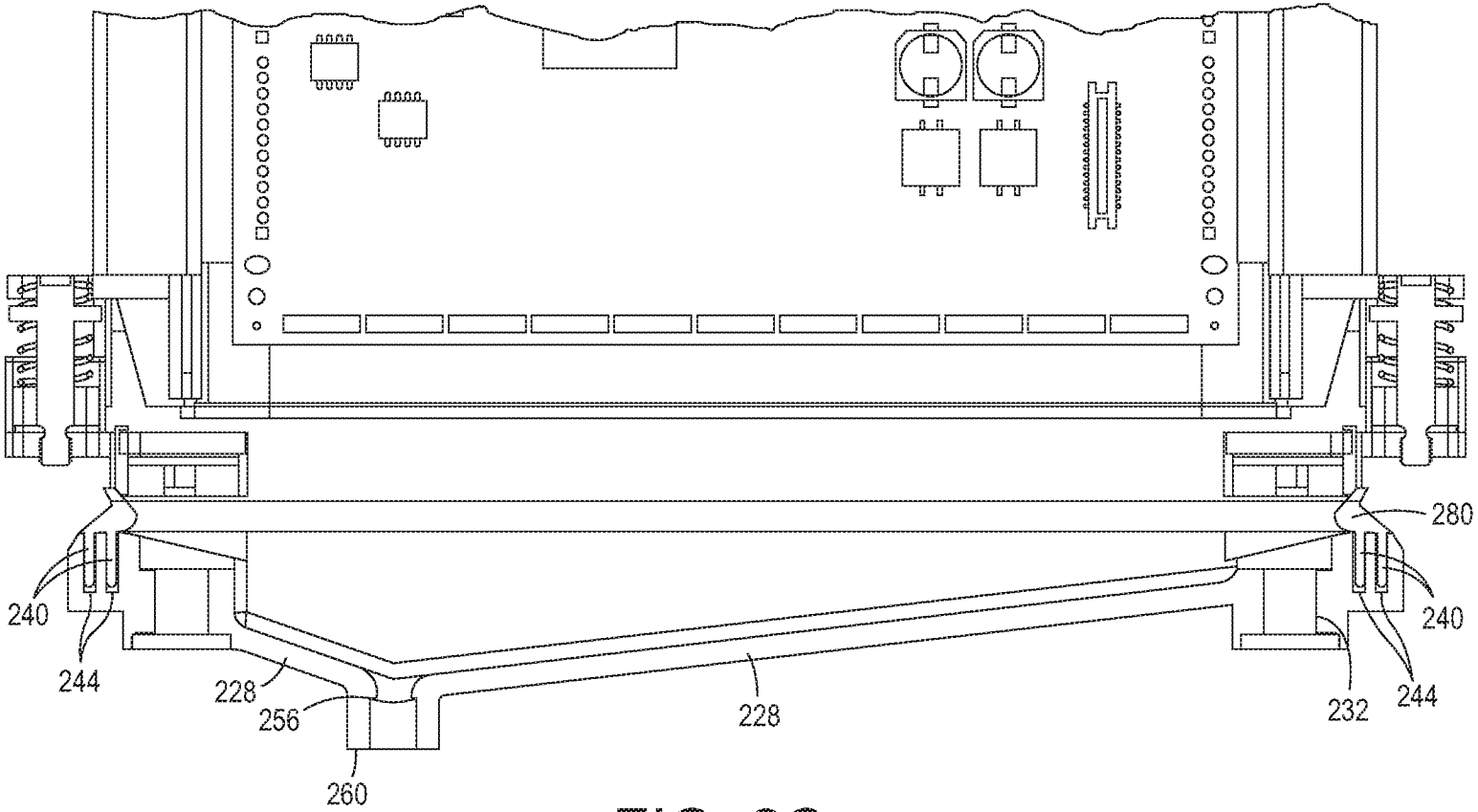
FIG. 2C is a longitudinal side view of the printhead capping system of FIG. 2C.

In more detail, the sealing member 208 has mounting tabs 240 that are inserted into mounting openings 244 of the receptacle 204 to secure the sealing member 208 to the receptacle 204. The lip of the sealing member 208 has a sloping flange 248 around its perimeter. The upper surface of flange 248 is oriented at an angle that directs ink that lands on that surface of the sealing member 208 toward the volume within the receptacle 204 so the ink can be collected. The flange 248 slopes at an angle from a vertical line extending from the upper surface of the wall forming the receptacle 204 in a direction away from the volume partially enclosed by the receptacle. This angle is within a range of about 10 degrees from the line in the direction away from the volume within the receptacle to about 40 degrees from that line in the same direction. Floor 228 also slopes toward an opening 256 in the floor and the opening extends through an outlet 260. A collection vessel can be connected to the outlet 256 to receive ink directed by the sloping floor 228 toward the opening 256. These sloping structures provide paths for ink on the faceplate of the printhead 268 that contact the sealing member 208 so the ink does not remain on the sealing member and dry. As noted previously, dried ink can interfere with the integrity of the seal between sealing member 208 and the faceplate of the printhead 268. Locating tabs 224 extend from the wall of the receptacle 204 past the upper surface of the sealing member 208 so the tabs contact the printhead before the sealing member does during the movement of the capping station 60' toward the printhead. This engagement helps center the printhead faceplate within the capping station so the sealing member 208 contacts the portion of the faceplate perimeter that is outside the nozzle array area of the faceplate. When the printhead is capped by the station 60', the faceplate is not visible (FIG. 2B and FIG. 2C).

Figure 3A:
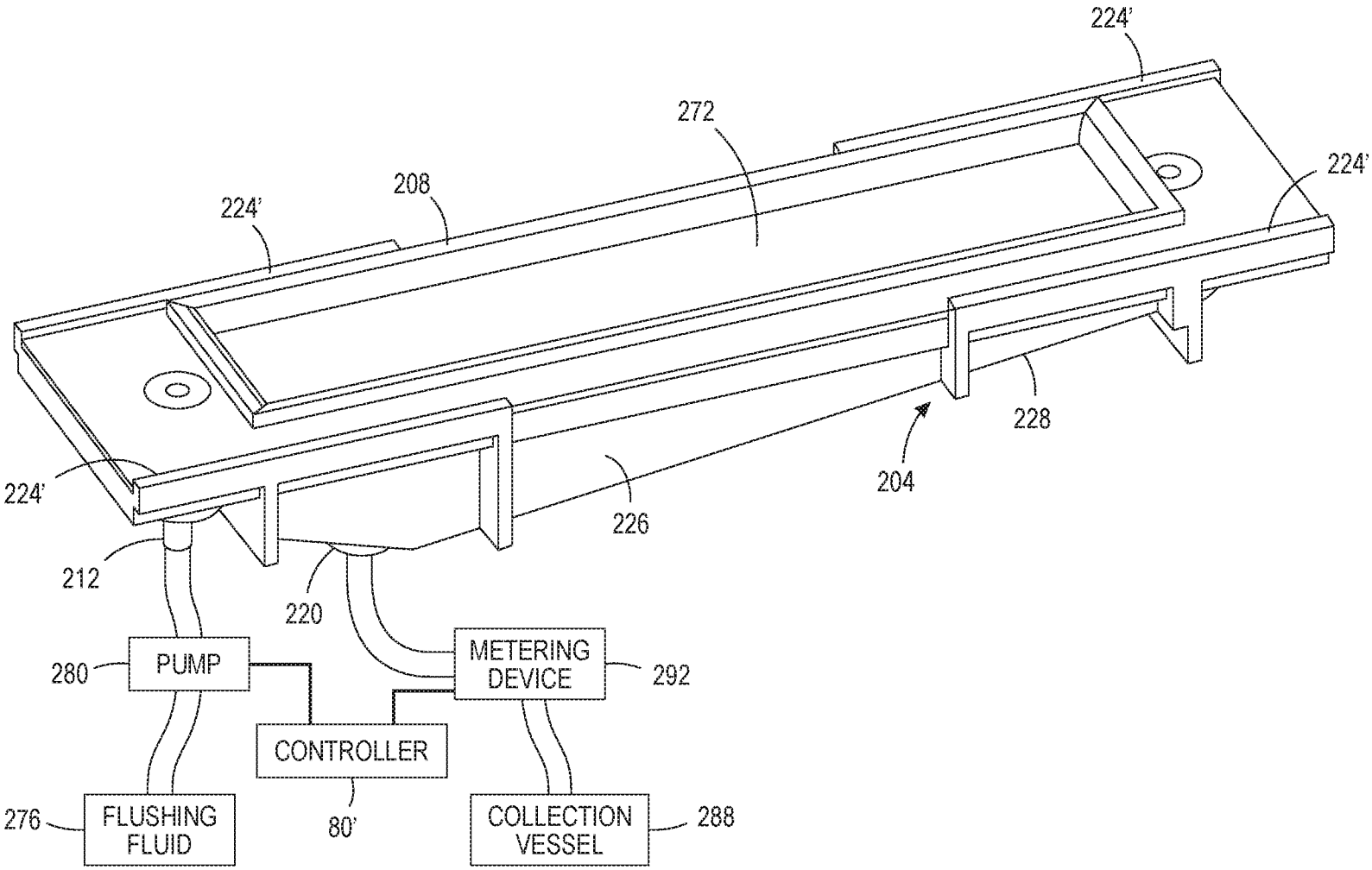
FIG. 3A is an isometric view of an alternative embodiment of the printing capping system that includes a shelf to hold a fluid against the inkjet nozzles of the printheads during printer inactivity.
Figure 3B:
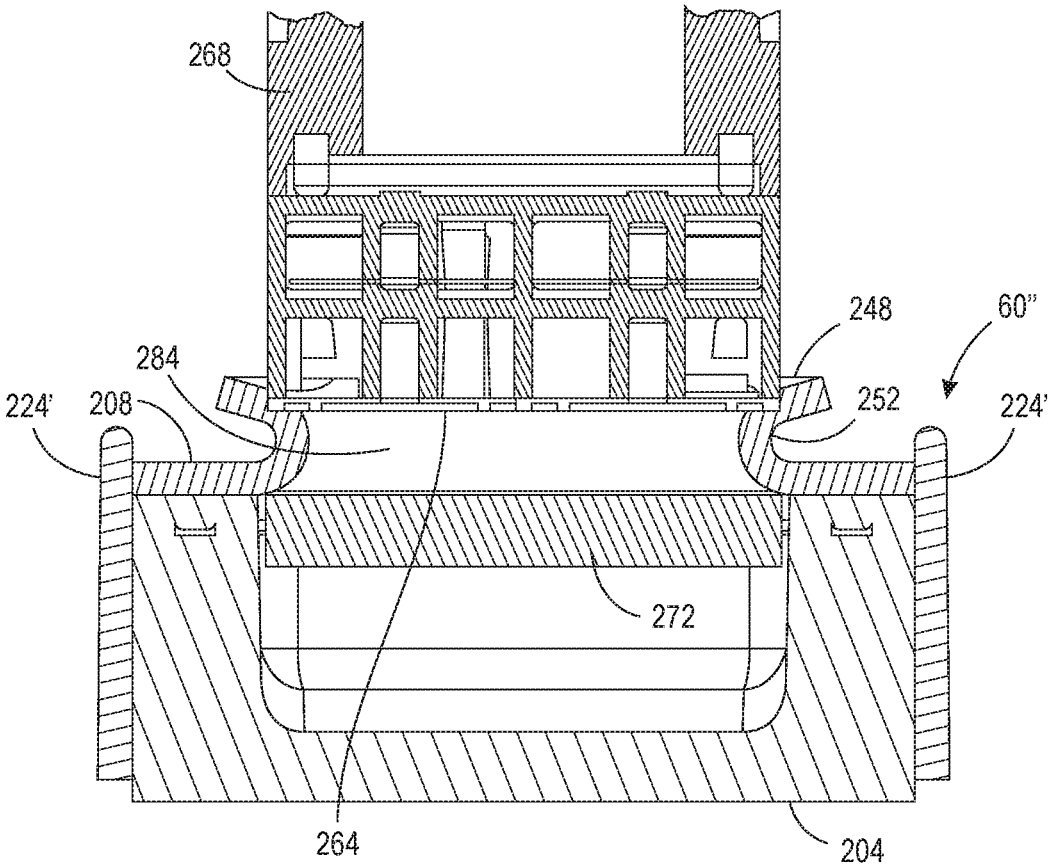
FIG. 3B is an end view of the printhead capping station shown in FIG. 3B.

Using similar reference numbers for similar elements, an alternative embodiment 60" of the capping station is shown in FIG. 3A and FIG. 3B. The capping station 60" includes a receptacle 204, a sealing member 208, a flushing fluid connection 212, a fluid outlet 220, and locating tabs 224'. Again, receptacle 204 is a housing having at least one wall 226 and a floor 228 that partially surrounds a volume of air. The sealing member 208 is mounted along the perimeter of the receptacle at an upper surface of the wall of the receptacle 204. This seal is made of an elastomeric material that hermetically seals the volume within the receptacle 204 when the controller 80' operates one of the actuators 40 to move the receptacle vertically toward the printhead 268 (FIG. 3B) so the sealing member contacts and surrounds the portion of the perimeter of the nozzle faceplate 264 of the printhead 268 (FIG. 3B) that is outside the nozzle array area of the faceplate. One of the actuators 40 is operatively connected to the receptacle 204 and the controller 80' to enable the controller to operate the actuator and move the capping station 60' into and out of engagement with a printhead.

With continued reference to FIG. 3A and FIG. 3B, a planar member 272 is installed within the air volume of receptacle 204 at a position that is separated by a predetermined distance from a faceplate of a printhead being capped by the station 60". This planar member 272 is connected, either removably or integrally, to the wall of the receptacle 204 at the positions on opposite ends of the longitudinal axis of the receptacle that is parallel to its length, which is greater than its width. On the edges of the planar member 272 that are parallel to the longitudinal axis of the receptacle, the edges of the planar member are separated from the wall of the receptacle by a predetermined distance so fluid can pass between the planar member and the wall of the receptacle in these areas. A source 276 of flushing fluid, such as distilled water or commercial printhead flushing fluid, is connected to the fluid inlet 212 through a pump 280. As used in this document, "flushing fluid" means any fluid capable of dissolving ink ejected from the printheads of a printer. The controller 80' is operatively connected to the pump 280 and is configured to operate the pump selectively to move flushing fluid through a passageway from the fluid inlet 212 onto the upper surface of the planar member 272 inside the receptacle 204. This fluid 284 is trapped between the upper surface of the planar member 272 and the faceplate of a printhead 268 (FIG. 3B). The flushing fluid 284 prevents ink from drying at the nozzles and on the faceplate. Additionally, the flushing fluid dissolves dried ink at the nozzles and on the faceplate, which aids in restoring clogged or inoperative inkjets to their operational condition. Some of the flushing fluid drains through the gaps at the edges of the planar member 272, is directed onto the floor 228 of the receptacle 204, is removed from the receptacle through the fluid outlet 220, and directed to a collection vessel 288. A metering device 292 is installed within the fluid path from the fluid outlet 220 to the collection vessel 288. The metering device is configured to generate a signal indicative of the fluid flow that reaches the fluid outlet 220 of the receptacle 204. The controller is operatively connected to the metering device 292 and uses the signal from the metering device to determine when the pump is operated to add flushing fluid into the volume between the planar member 272 and the faceplate of the printhead 268 to replace the fluid lost through the gaps at the edges of the planar member 272.

Figure 4:
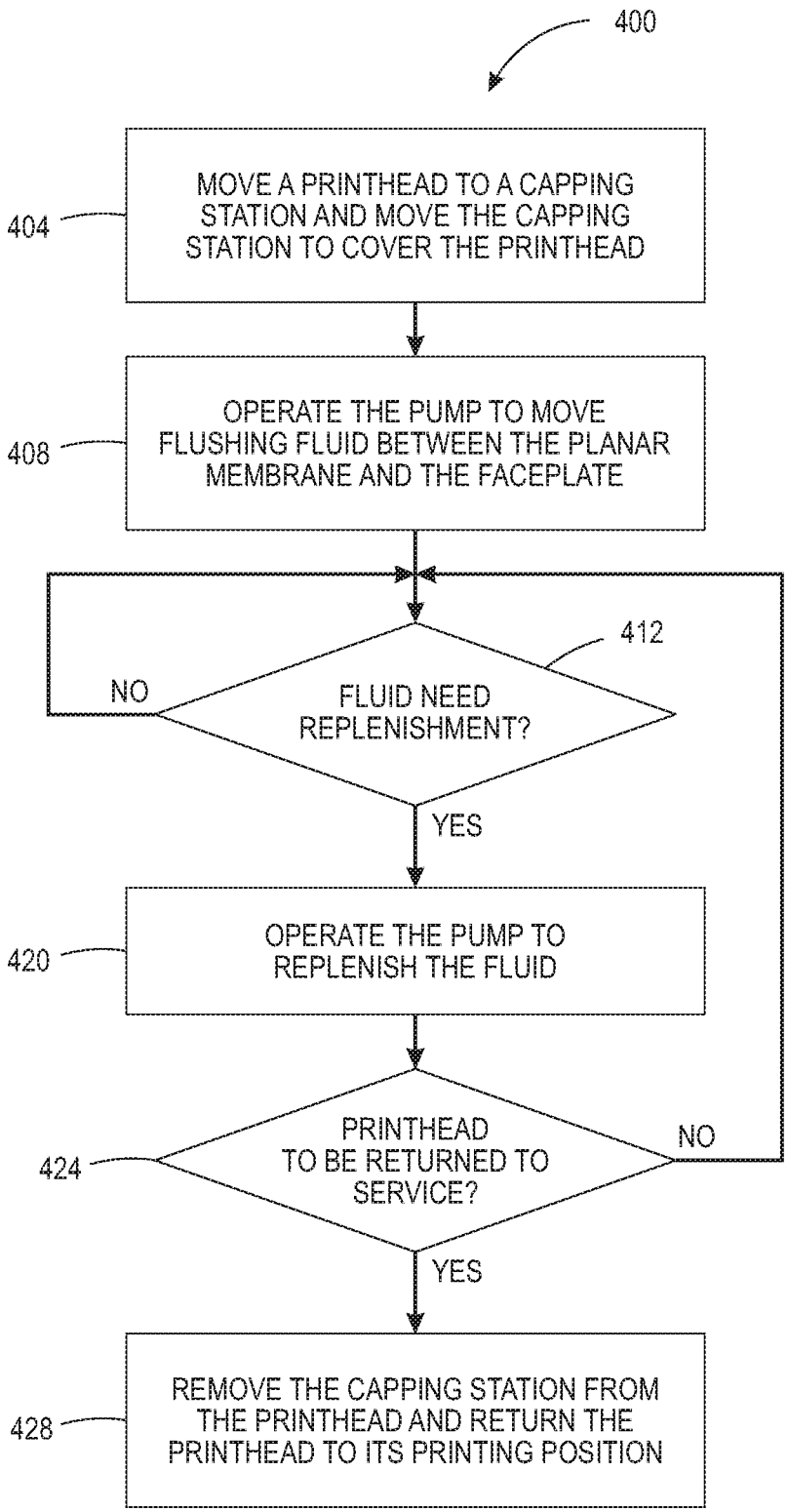
FIG. 4 is a flow diagram of a process for capping a printhead in the printer of FIG. 1 to restore and preserve the operational status of the inkjets in the printheads of the printers.

FIG. 4 depicts a flow diagram for the process 400 that operates the capping system 60" to cover the faceplate of the printhead with a film to preserve the viscosity of the ink in the nozzles at the low viscosity. In the discussion below, a reference to the process 400 performing a function or action refers to the operation of a controller, such as controller 80', to execute stored program instructions to perform the function or action in association with other components in the printer. The process 400 is described as being performed with capping station 60" being substituted for capping station 60' in the printer 10 of FIG. 1A and FIG. 1B for illustrative purposes.

The process 400 of operating the capping station 60" is now discussed with reference to FIG. 4 and the illustrations of FIG. 3A and FIG. 3B. When the printhead is to be capped for a relatively long period of printer inactivity, the controller 80' operates one or more actuators to move the printhead opposite the capping station 60" and then operates an actuator 40 to engage the faceplate of the printhead with the sealing member 208 of the capping station 60" so the planar member 272 is proximate but not touching the faceplate of the printhead 268 (block 404). In one embodiment, the gap between the faceplate 264 and the ink receiving surface 272 of the planar member 228 is in a range of about 250 microns to about 500 microns. The controller 80' operates the pump 280 to move flushing fluid 284 from the flushing fluid source 276 into the gap between the planar member 272 and the faceplate of the printhead (block 408). One example of a cleaning fluid that can be used in the capping station is Nippon Kayaku Kayajet CL-66. The controller monitors the signal from the metering device 292 (block 412) and when flushing fluid is needed to replace the flushing fluid collected from the receptacle, the controller operates the pump 280 to replace the amount of fluid indicated by the metering device signal since the last fluid pumping operation (block 420). This process of detecting and replenishing lost flushing fluid continues (blocks 412 to 424) until the period of inactivity is completed and the printhead is to be returned to operational status (block 424). To return the printhead to operational service, the controller 80' operates the actuators to pull the capping station 60" away from the printhead 268 so the sealing member disengages the faceplate of the printhead and then operates another actuator to return the printhead to its operational position (block 428).

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A capping station for storing printheads during periods of printhead inactivity comprising:

a receptacle having at least one wall and a floor configured to enclose a volume partially; and a sealing member mounted to an upper surface of the at least one wall of the receptacle so the sealing member extends away from the upper surface of the at least one wall, the sealing member having a surface that slopes at an angle within a range of about 10 degrees from a vertical line extending from the upper surface of the wall forming the receptacle in a direction away from the volume partially enclosed by the receptacle to about 40 degrees away from the line extending vertically from the upper surface of the at least one wall of the receptacle to direct fluid on the sloping surface of the sealing member into the volume within the receptacle.

2. The capping station of claim 1 wherein the floor has an opening.

3. The capping station of claim 2 wherein the floor slopes toward the opening to direct fluid on the floor into the opening.

4. The capping station of claim 3 wherein the sealing member is comprised essentially of an elastomeric material.

5. The capping station of claim 4, the receptacle further comprising:

at least two protrusions positioned on opposite sides of a longitudinal axis of the receptacle, the protrusions extending from the upper surface of the at least one wall of the receptacle to a position that is past an upper surface of the sealing member.

6. The capping station of claim 5, the receptacle further comprising:

a planar member having a length and a width, the length of the planar member being greater than the width of the planar member and the planar member being positioned in the volume of the receptacle at a predetermined distance from the upper surface of the at least one wall of the receptacle with the planar member being attached to the at least one wall of the receptacle at opposite ends of the length of the planar member and a gap of a predetermined distance separating edges of the planar member on opposite sides of the width of the planar member from the at least one wall of the receptacle.

7. The capping station of claim 6 further comprising:

an actuator operatively connected to the receptacle, the actuator being configured to move the receptacle bidirectionally along an axis that is perpendicular to the longitudinal axis of the receptacle; and a controller operatively connected to the actuator, the controller being configured to operate the actuator to move the receptacle and engage the sealing member with a faceplate of a printhead.

8. The capping station of claim 7 further comprising:

a pump operatively connected between a source of flushing fluid and a passageway in the at least one wall of the receptacle that opens onto an upper surface of the planar member; and the controller being operatively connected to the pump, the controller being further configured to operate the pump to move flushing fluid from the flushing fluid source to the upper surface of the planar member.

9. The capping station of claim 8 further comprising:

a metering device operatively connected to the opening in the floor of the receptacle, the metering device being configured to generate a signal indicative of an amount of flushing fluid received at the opening in the floor of the receptacle; and the controller being operatively connected to the metering device to receive the signal generated by the metering device, the controller being further configured to operate the pump to move flushing fluid to the upper surface of the planar member using the signal generated by the metering device to replenish flushing fluid that passed through the gaps between the edges of the planar member and the at least one wall of the receptacle.

10. A printer comprising:

a plurality of printheads; and a capping station for each printhead in the plurality of printheads, each capping station including:

a receptacle having at least one wall and a floor configured to enclose a volume partially; and a sealing member mounted to an upper surface of the at least one wall of the receptacle so the sealing member extends away from the upper surface of the at least one wall, the sealing member having a surface that slopes at an angle within a range of about 10 degrees from a vertical line extending from the upper surface of the wall forming the receptacle in a direction away from the volume partially enclosed by the receptacle to about 40 degrees away from the line extending vertically from the upper surface of the at least one wall of the receptacle to direct fluid on the sloping surface of the sealing member into the volume within the receptacle.

11. The printer of claim 10 wherein the floor of each receptacle in each capping station has an opening.

12. The printer of claim 11 wherein the floor of each receptacle in each capping station slopes toward to the opening to direct fluid on the floor into the opening.

13. The printer of claim 12 wherein the sealing member of each capping station is comprised essentially of an elastomeric material.

14. The printer of claim 13, the receptacle of each capping station further comprising:

at least two protrusions positioned on opposite sides of a longitudinal axis of the receptacle, the protrusions extending away the receptacle to a position that is past an upper surface of the sealing member.

15. The printer of claim 14, the receptacle of each capping station further comprising:

a planar member having a length and a width, the length of the planar member being greater than the width of the planar member and the planar member being positioned in the volume of the receptacle at a predetermined distance from the upper surface of the at least one wall of the receptacle with the planar member being attached to the at least one wall of the receptacle at opposite ends of the length of the planar member and a gap of a predetermined distance separating edges of the planar member on opposite sides of the width of the planar member from the at least one wall of the receptacle.

16. The printer of claim 15, each capping station further comprising:

an actuator operatively connected to the receptacle, the actuator being configured to move the receptacle bidirectionally along an axis that is perpendicular to the longitudinal axis of the receptacle; and a controller operatively connected to the actuator, the controller being configured to operate the actuator to move the receptacle and engage the sealing member with a faceplate of a printhead.

17. The printer of claim 16, each capping station further comprising:

a pump operatively connected between a source of flushing fluid and a passageway in the at least one wall of the receptacle that opens onto an upper surface of the planar member; and the controller being operatively connected to the pump, the controller being further configured to operate the pump to move flushing fluid from the flushing fluid source to the upper surface of the planar member.

18. The printer of claim 17, each capping station further comprising:

a metering device operatively connected to the opening in the floor of the receptacle, the metering device being configured to generate a signal indicative of an amount of flushing fluid received at the opening in the floor of the receptacle; and the controller being operatively connected to the metering device to receive the signal generated by the metering device, the controller being further configured to operate the pump to move flushing fluid to the upper surface of the planar member using the signal generated by the metering device to replenish flushing fluid that passed through the gaps between the edges of the planar member and the at least one wall of the receptacle.

* * * * *